US011104542B2

(12) United States Patent
Lagace et al.

(10) Patent No.: US 11,104,542 B2
(45) **Date of Patent: *Aug. 31, 2021**

(54) WINDING CORE

(71) Applicant: Sonoco Development, Inc., Hartsville, SC (US)

(72) Inventors: Chad E. Lagace, Cohoes, NY (US); Fedor Baranov, East Greenbush, NY (US)

(73) Assignee: Sonoco Development, Inc, Hartsville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/749,455

(22) Filed: Jan. 22, 2020

(65) Prior Publication Data

US 2020/0156899 A1 May 21, 2020

Related U.S. Application Data

(63) Continuation of application No. 15/896,160, filed on Feb. 14, 2018, now Pat. No. 10,569,989.

(51) Int. Cl.

| | |
|---|---|
| ***B65H 75/22*** | (2006.01) |
| ***B65H 75/10*** | (2006.01) |
| ***B65H 75/14*** | (2006.01) |

(52) U.S. Cl.

CPC ..... *B65H 75/22* (2013.01); *B65H 75/10* (2013.01); *B65H 75/14* (2013.01);

(Continued)

(58) Field of Classification Search

CPC ..... B65H 75/10; B65H 75/22; B65H 75/14; B65H 75/2218; B65H 75/2254; B65H 75/2281

(Continued)

(56) References Cited

U.S. PATENT DOCUMENTS

| | | | |
|---|---|---|---|
| 2,535,188 | A | 12/1950 | Beckner |
| 2,775,418 | A | 12/1956 | Cadman |

(Continued)

FOREIGN PATENT DOCUMENTS

| | | | |
|---|---|---|---|
| FR | 2281303 | A1 | 3/1976 |
| JP | H1111799 | A | 1/1999 |
| JP | 2009203029 | A | 9/2009 |

OTHER PUBLICATIONS

International Search Report and Written Opinion for corresponding international apllicaiton No. PCT/US2019/017280, dated May 29, 2019.

*Primary Examiner* — William E Dondero

(74) *Attorney, Agent, or Firm* — Flaster Greenberg PC

(57) ABSTRACT

A two piece winding core assembly is provided having a first core portion and a second core portion. The two core portions having the same construction and are positionable to combine together to form a completed cylindrical and hollow core. The two core portions having a series of locking pins and a corresponding series of receiving openings formed on opposing end faces. A series of axially elongated projections and a corresponding series of axially elongated channels are also formed on the opposing end faces of the core portions. An internal plurality of web members is formed in a structural crossing pattern on the inside surface of the core portion, with the web members providing structural rigidity to the core portions.

18 Claims, 8 Drawing Sheets

(52) U.S. Cl.
CPC ..... *B65H 75/2218* (2021.05); *B65H 75/2254* (2021.05); *B65H 2402/63* (2013.01); *B65H 2701/5122* (2013.01); *B65H 2701/5136* (2013.01)

(58) Field of Classification Search
USPC ..... 242/609.1
See application file for complete search history.

(56) References Cited

U.S. PATENT DOCUMENTS

| | | | | |
|---|---|---|---|---|
| 3,358,943 | A | 12/1967 | Pelson | |
| 3,940,085 | A | 2/1976 | Campbell | |
| 4,471,919 | A | 9/1984 | Leunig | |
| 5,575,437 | A | 11/1996 | Campbell | |
| 5,806,788 | A | 9/1998 | Witwer et al. | |
| 5,967,244 | A | 10/1999 | Farber | |
| 7,036,766 | B2 | 5/2006 | Place et al. | |
| 8,328,127 | B2 | 12/2012 | Ito et al. | |
| 8,424,796 | B2 | 4/2013 | Witwer | |
| 10,569,989 | B2 * | 2/2020 | Lagace ..... | B65H 75/22 |
| 2002/0053625 | A1 | 5/2002 | Charlton | |
| 2004/0173713 | A1 | 9/2004 | Barroso | |
| 2007/0262192 | A1 | 11/2007 | Derendal | |

* cited by examiner

WINDING CORE

CROSS REFERENCE TO RELATED APPLICATION

The present application is a continuation of copending U.S. application Ser. No. 15/896,160, filed Feb. 14, 2018, which issued as U.S. Pat. No. 10,569,989, on Feb. 25, 2020

FIELD OF THE INVENTION

The present disclosure relates to a core assembly to be used as or part of a reel or spool to store and transport wound elongated flexible material, such as wire or cable.

BACKGROUND OF THE INVENTION

A core may be used as a base for winding elongated flexible material, such as wire or cable. The core may be attached to flanges, positioned at one or both ends of the core, or may be free floating on a support structure. A core formed as a single piece inherently occupies a relatively large volume during shipment from the factory to the customer who will wind the elongate material thereon. A core formed on multiple pieces will occupy significantly less volume during shipment in the dis-assembled condition.

Multi-part core and spool assemblies are known. These assemblies may include locking pins to mechanically align the parts together. See, e.g., U.S. Pat. Nos. 2,775,418 and 3,358,943. Axially elongated mating surfaces may also be included in a core assembly. See, U.S. Pat. Nos. 3,940,085 and 5,575,437. Locking pins and elongated mating surfaces may also be included in combination. See U.S. Pat. No. 5,806,788 and US 2002-0053625.

Structural ribs may be provided on the inside surface of a multi-part core structure. See U.S. Pat. Nos. 8,328,127, 8,424,796 and US 2007-0262192. External ribbing for strengthening the core parts may also be provided. See U.S. Pat. No. 7,036,766.

In creating a multi-part core assembly, it is desirable to avoid the use of a chemical or adhesive bond. Such bond formations may create unwanted complications as part of the assembly or during use. The types of bonds may also prevent the dis-assembly of the core after an initial use.

Complicated mechanical structures may also present difficulties in the assembly and dis-assembly of the core portions.

SUMMARY OF THE INVENTION

In a first aspect of the disclosure, a winding core assembly is provided forming a substantially cylindrical hub formed by two core portions. Each core portion preferably includes an arcuate sidewall formed about a longitudinal axis, with the arcuate segment having a semi-cylindrical outer wall and a concave inner surface. The concave inner surface of the core portions may include a plurality of web members formed in a crossing pattern along the surface, serving to strengthen the sidewall. First and second longitudinally extending end faces surfaces are positioned on opposite sides of the arcuate segment, with the end face surfaces being substantially aligned with one another. A first end face includes a plurality of projecting pins and multiple elongated channels. Preferably, at least one of the channels is positioned between two projecting pins. A second end face includes a plurality of pin receiving openings formed therein and multiple longitudinally positioned, axially elongated projections. The elongated projections are preferably positioned between two receiving openings. The pins on the first end face are aligned along the axial length of the core portion with the axial position of the openings on the second end face. The elongated channels on the first end face are also aligned axially with the elongated projections of the second face.

In a further aspect of the winding core the outer wall surfaces of the sidewall may be provided, adjacent to the first and second end face surfaces, with a recessed support structure. The recessed support structure preferably includes a series of spaced support ribs directed transverse to the end face, with the ribs having a radial outer surfaces that are substantially aligned with the arcuate surface of the outer wall.

Is In a further aspect of the disclosure, a two piece winding core assembly is provided having a first core portion and a second core portion. The two core portions include the same construction and are positionable to combine together to form a completed cylindrical and hollow core. The two core portions preferably include a series of projecting pins and a corresponding series of receiving openings formed on opposing axially extending end face surfaces. A series of axially elongated projections and a corresponding series of axially elongated channels are also formed on the opposing end face surfaces on the core portions. An internal plurality of web members is formed in a structural crossing pattern on the inside surface of the core portion, with the web members providing structural rigidity to the core portions.

Other features of the contemplated invention and alternate combinations of features will be apparent from the detailed description to follow, taken in conjunction with the accompanying drawings.

BRIEF DESCRIPTION OF THE DRAWINGS

For the purpose of illustrating the invention, the drawings show one or more forms that are presently preferred. It should be understood that the invention is not limited to the precise arrangements and instrumentalities shown in the drawings.

DETAILED DESCRIPTION

Figure 1:
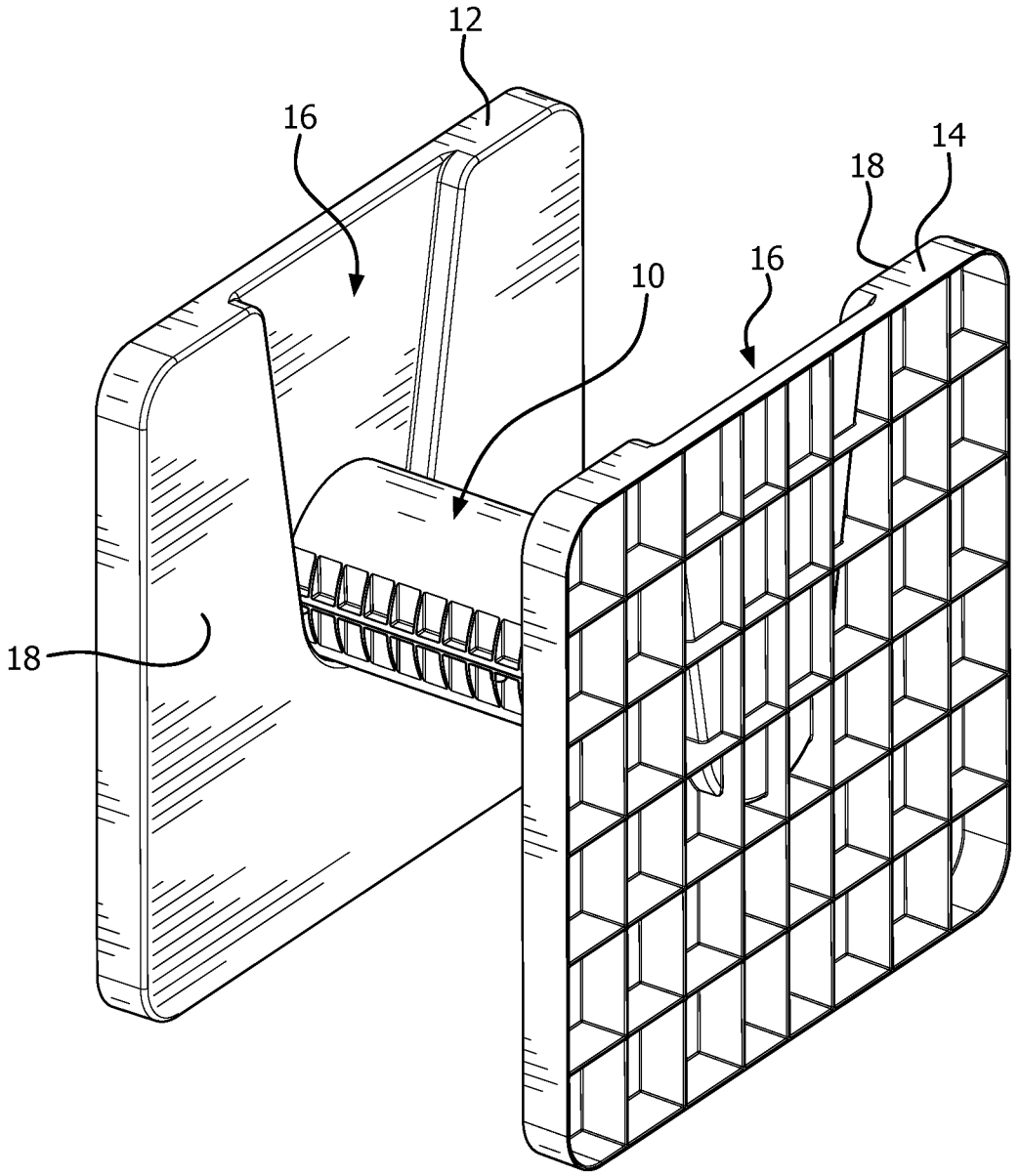
FIG. 1 shows an isometric view of an embodiment of a core that is freely supported on two end supports.

In the figures, where like numerals identify like elements, there is shown an embodiment of a core to be used for winding a flexible elongated material, such as wire or cable. The core is designated by the numeral 10. As shown in FIG. 1, the core 10 forms a substantially cylindrical hub that is horizontally positioned between two support plates 12, 14. Each plate 12, 14 includes a slot 16 formed on a facing surface 18. The slot 16 receives and supports one end of the core 10. In the supported position, the core 10 is free floating and may rotate about its longitudinal axis do dispense the elongate material (not shown) that is wound on the core 10. The plates 12, 14 may be positioned within a box or carton (not shown) that serves to protect the elongate material during storage and shipment. In an alternative embodiment, the core 10 may be attached at each end to a flange member (not shown) a reel or spool construction. Any desired attachment method or structure (not shown) may be utilized to create the spool or reel using the illustrated core 10.

Figure 2:
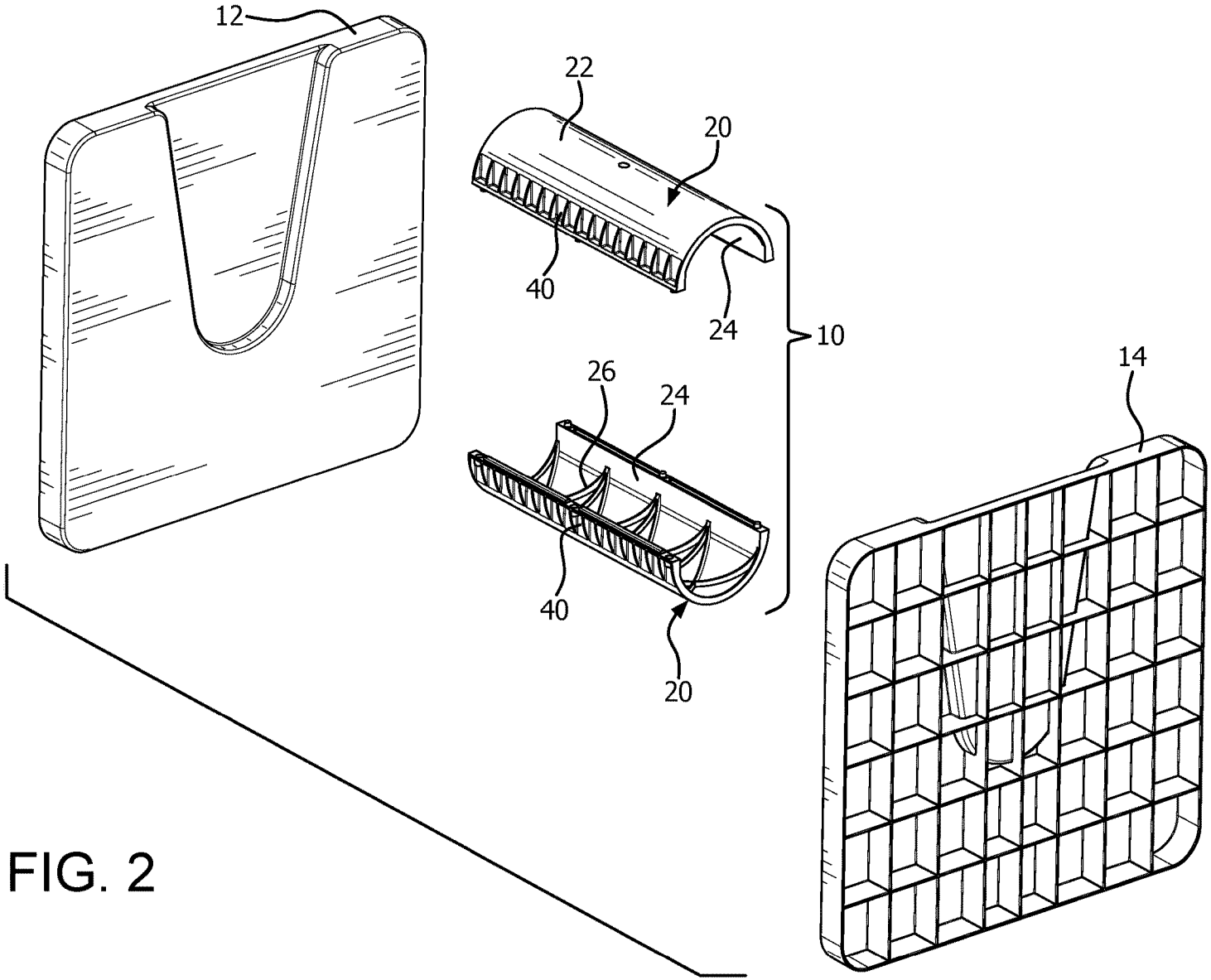
FIG. 2 shows an exploded isometric view of the core and the end supports of FIG. 1.
Figure 3B:
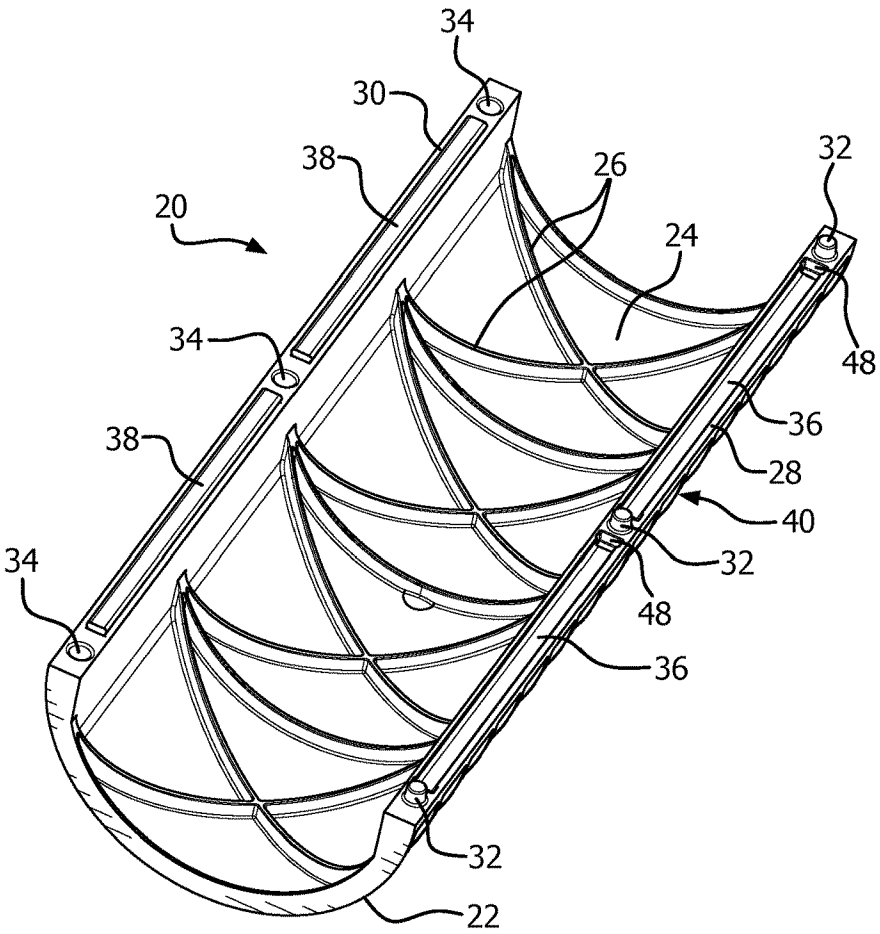
FIG. 3B shows an isometric view a second core portion, wherein the second core portion has the identical construction as the first core portion.
Figure 3A:
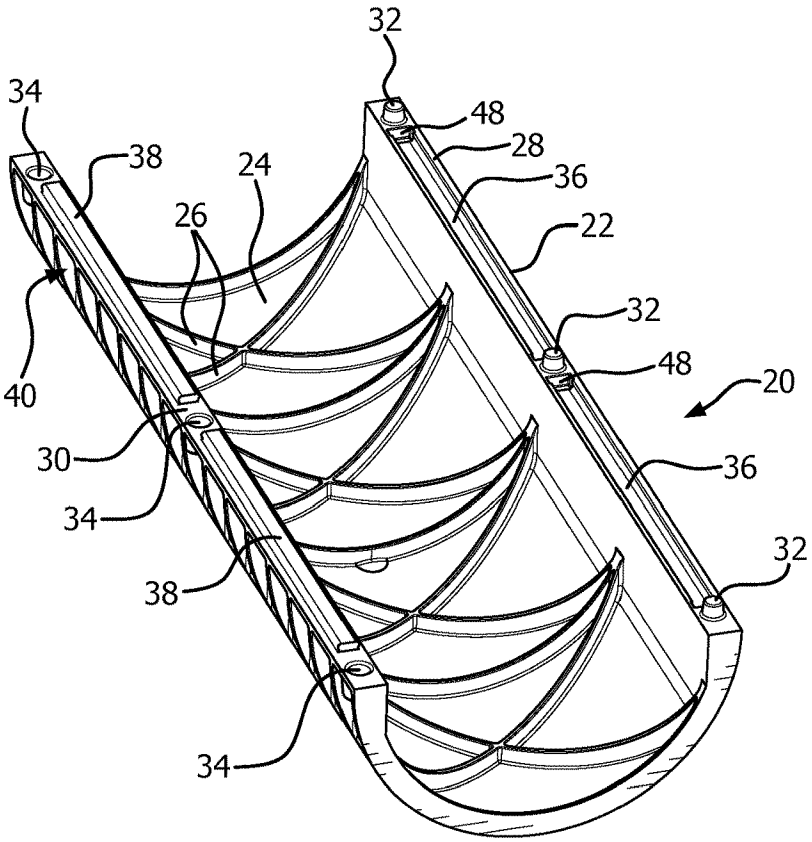
FIG. 3A is an isometric view of a first core portion.

The core 10 and plates 12, 14 are shown in an exploded condition in FIG. 2. The core 10 is formed from an assembly of two core portions 20. As will be discussed in greater detail below, each core portion 20 is identically formed and includes attachment means for securing one portion to the other. The two core portions 20 are shown in FIGS. 3A and 3B. Each portion 20 includes an outer side wall 22 having as an arcuate or semi-cylindrical segment formed about a longitudinal axis. A concave inner surface 24 includes a plurality of internal web members 26 formed in a crossing pattern. The sidewalls 22 of the core portion 20 end in first and second planar end face surfaces 28, 30 (respectively) positioned on opposite sides of the arcuate segment and extending axially. The end faces 28, 30 are substantially aligned with one another and with the longitudinal axis.

A portion of the attachment means for the two core portions 20 is provided on the first end face 28. A plurality of projecting pins 32 extending perpendicular from the end face surface. The corresponding attachment means structure on the second end face 30 comprises a plurality of pin receiving axial openings 34. Multiple elongated receiving channels or grooves 36 are formed on the first end face 28. As illustrated, there are three pins 32 on the first end face 28 and one of the channels 36 is positioned between two projecting pins 32. The second end face includes multiple elongated projections 38. One of the projections 38 is positioned between two receiving openings 34. The pins 32 on the first end face 28 aligned axially with the receiving openings 34 on the second end face 30. Likewise, the receiving grooves 36 on the first end face 28 aligned axially with the elongated projections 38 on the second end face 30.

Figure 4:
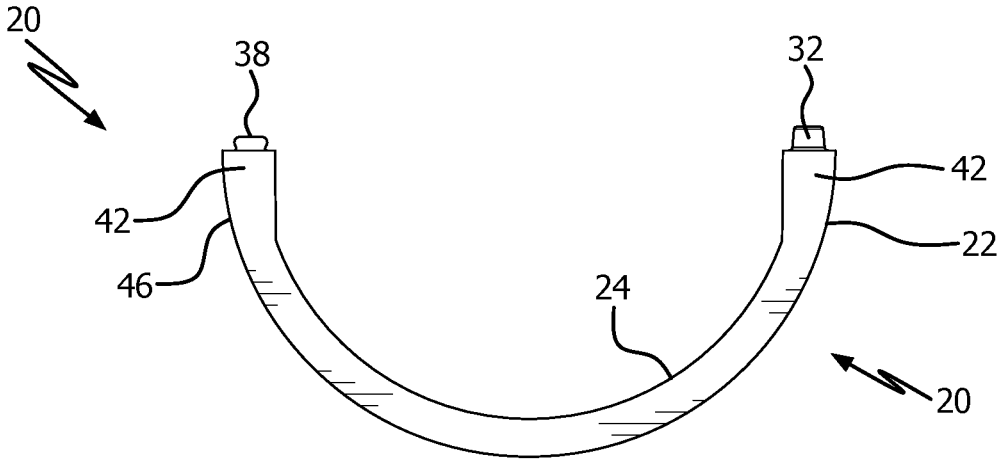
FIG. 4 shows an end view of the first core portion.
Figure 5:
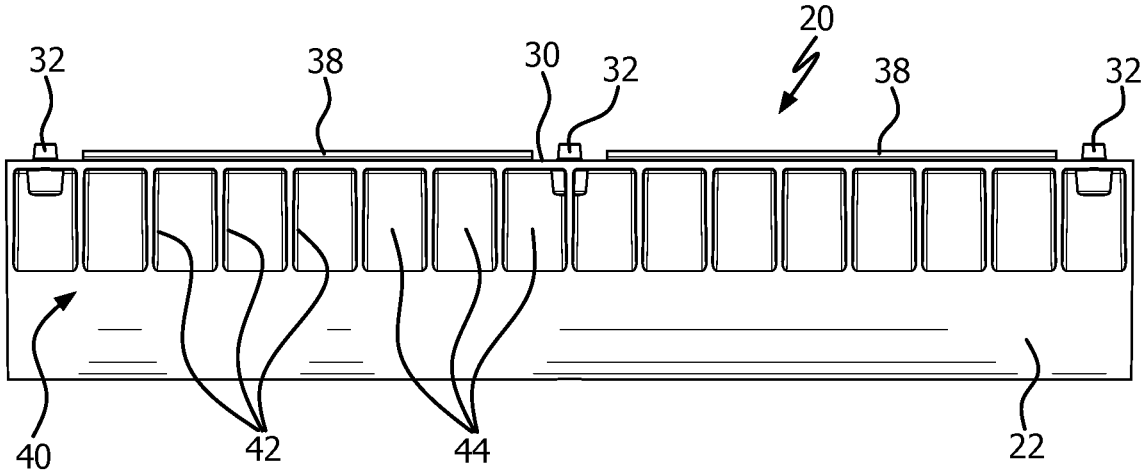
FIG. 5 shows a side elevation of first core portion.
Figure 7:
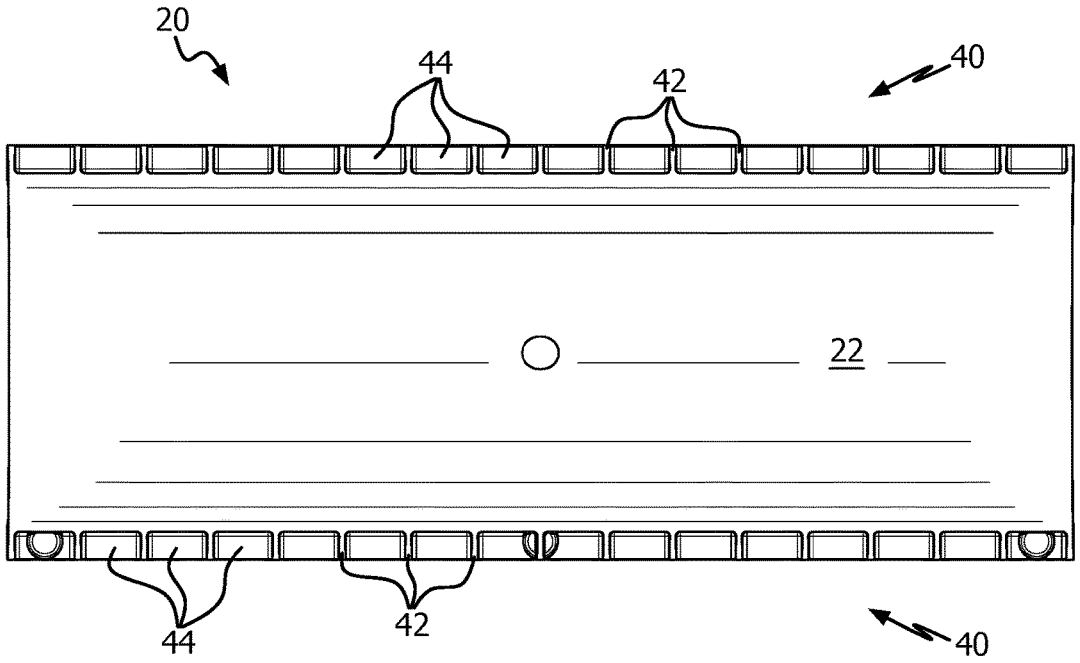
FIG. 7 shows a bottom plan view of the first core portion, showing the external structures.

As more particularly shown in FIGS. 5 and 7, the outer wall surface 22 of the core portions 20, adjacent both the first and second end faces 28, 30, includes a recessed support structure 40. The support structure 40 comprising a series of spaced ribs 42 formed within a recessed channel 44. The ribs 42 are formed beneath and directed transverse and preferably perpendicular to the planar end face surfaces 28, 30. As shown from the end view of FIG. 4 and the cross sections of FIGS. 9 and 10, the support ribs 42 include a radial outer edge surfaces 46 that are substantially aligned with and conforms to the surface of the outer wall 22.

Figure 6:
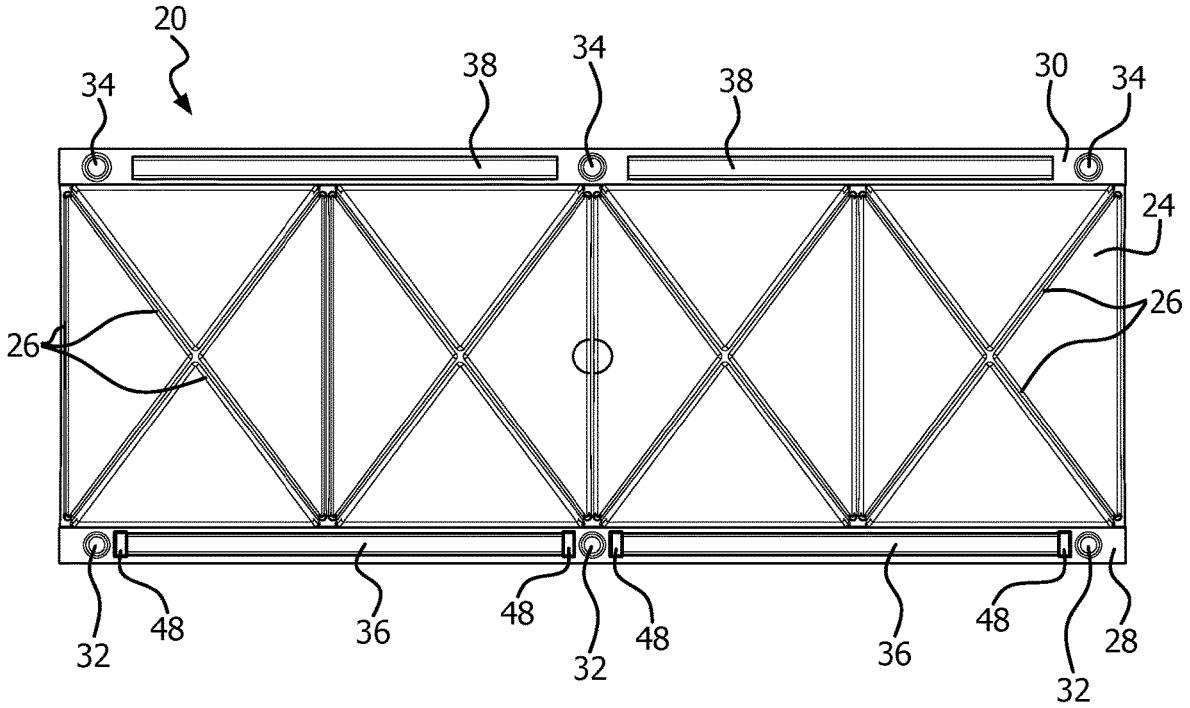
FIG. 6 shows a top plan view of the first core portion, illustrating the internal structures.

In FIG. 6, the inside surface 24 of the core portion 20 is show, exposing the crossing pattern for the internal web members 26. The web members 26 are positioned in multiple directions, with some being angled with respect to the axis of the core portion and some being transvers—and preferably perpendicular—to the longitudinal axis. The web members 26 further form a series of angled intersections. Additional web members may be positioned at other angles or positioned in an axial direction within the crossing pattern. Preferably, the core portion 20 is integrally molded from a thermoplastic material, with the web members 26 formed as part of the sidewall and integral with the inner surface. The web members 26 provide rigidity to the wall of the core member, while reducing the overall weight of the part. The crossing pattern of the web members 26 spreads out the strengthening support in both the axial and radial directions. The height and width of the web members may vary depending on the strength requirements for the core, the material being used and other formation and use parameters.

The first edge face 28 includes elongated receiving channels 36. As shown in at least FIGS. 3A, 3B and 6, relief openings 48 are positioned at each end of the receiving channels 36. The relief openings 48 are slightly broader than the width of the receiving channels 36. These relief openings 48 provide tolerance for the insertion of the elongated projections 38 into the receiving channels 36 during assembly of the core 10.

As show in FIG. 4, the pins 32 are preferably frusto-conical, having a flat head and a tapered sidewall. As shown in the assembly cross sections of FIGS. 9 and 10, the receiving openings 34 are internally tapered and receive the pins 32 with a relatively tight tolerance. This preferred fit between the pins 32 and the receiving openings 34 is more particularly shown in the enlarged cross section of FIG. 11.

Figure 12:
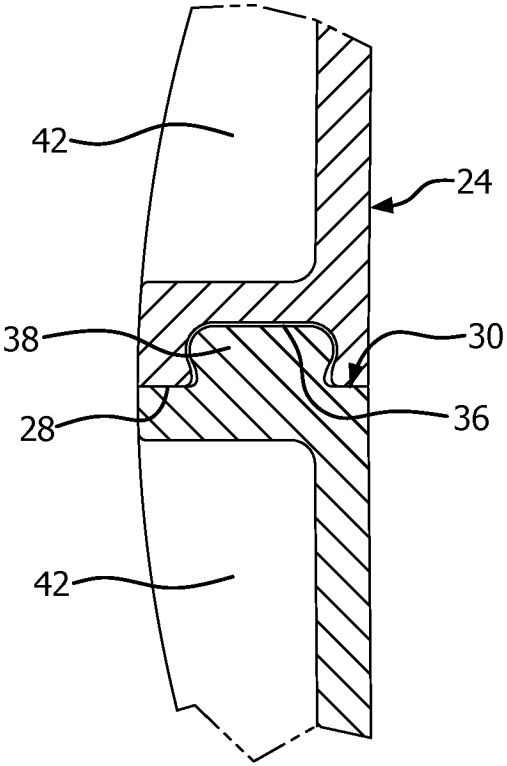
FIG. 12 shows an enlarged view of a portion of the sectioned assembly of FIG. 10.

As also shown in FIG. 4, the elongated projections 38 have a relatively narrow base and an outwardly projecting or bulbous head. In the assembly cross sections of FIGS. 9 and 10, the receiving channels 36 are shown as including a similar formation, with a narrow separation adjacent the second end face surface 30 and an expanded open portion formed internally. Again, the elongated projections 38 fit within the elongated channels 36 with a relatively tight tolerance. This fit between the projections 38 and the receiving channels 36 is more particularly shown in the enlarged cross section of FIG. 12.

Figure 8:
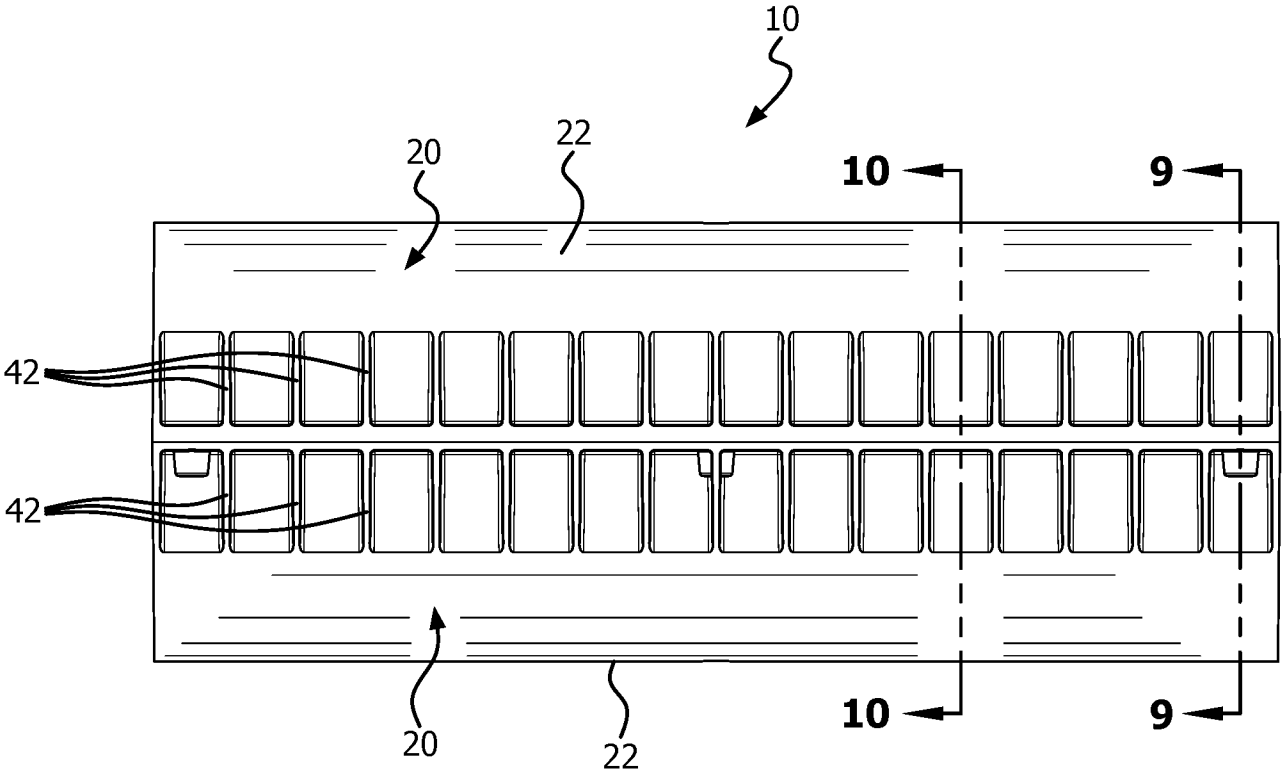
FIG. 8 shows a side elevation of an assembly of two core portions.
Figure 10:
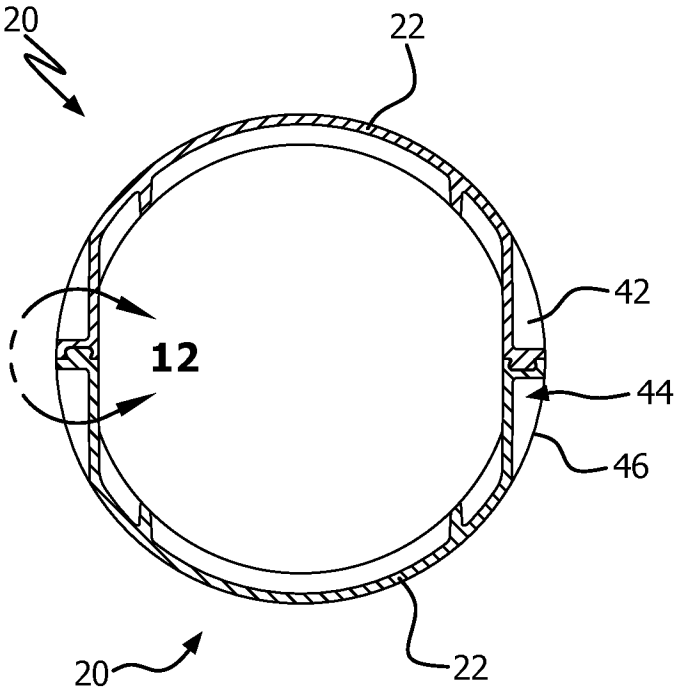
FIG. 10 shows a cross section view of the assembled core, with the section being taken along line 10-10 in FIG. 8.
Figure 9:
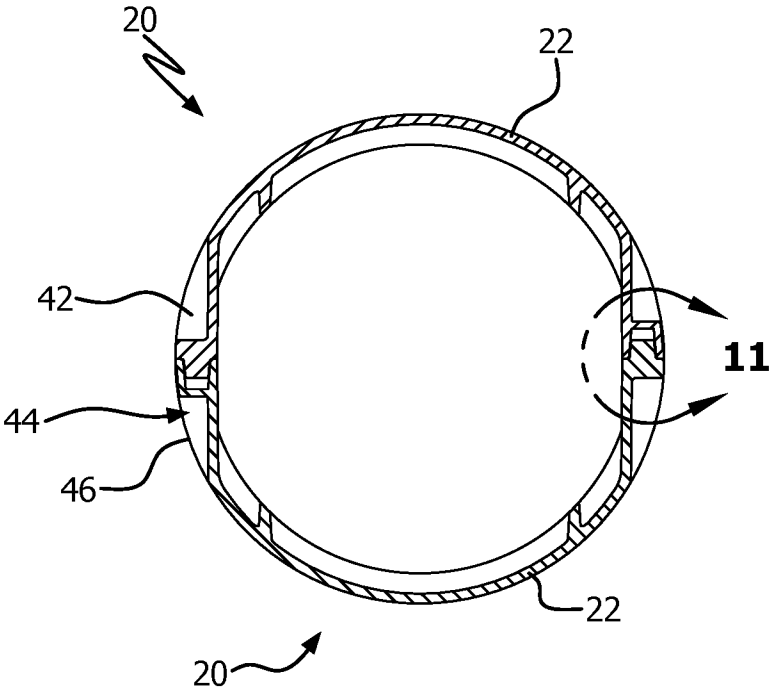
FIG. 9 shows a cross section view of the assembled core, with the section being taken along line 9-9 in FIG. 8.
Figure 11:
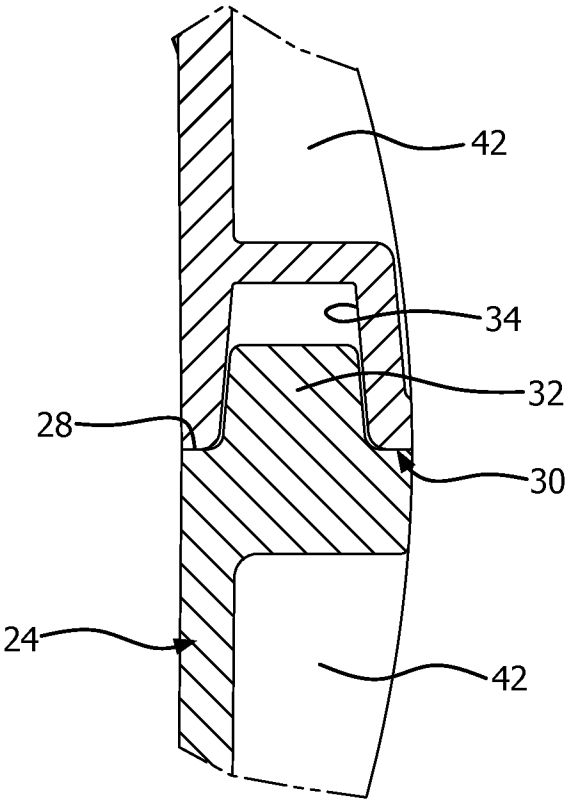
FIG. 11 shows an enlarged view of a portion of the sectioned assembly of FIG. 9.

The assembly of the core 10 is shown in side view in FIG. 8 and in the cross sections of FIGS. 9 and 10. The pins 32 are matched up to the receiving openings 34, with the elongated projections 38 aligned with the channels 36. As represented by the side-by-side FIGS. 3A and 3B, the identical core half 20 is used for the assembly, only with one half rotated into position to align the provided structures. In FIG. 8, the outer ribs are positioned to support their corresponding end face surfaces. In the side views of FIGS. 9 and 10, the edge 46 of the ribs 42 conforms to the circular contour of the outer side wall 22 of the core 10.

Generally, a two piece core will reduce the volume for shipping of the constituent parts to a winding operation. The core is shipped in the unassembled condition. The present core structure provides the advantage on accomplishing assembly without the need for chemical or adhesive bonding of the core portions. The asymmetrical design of the two end face surfaces 28, 30 allows for a single molded core portion 20 to serve as both halves of the assembled core 10.

The mechanical attachment means for the two core portions 20 includes the pins 32 and receiving openings 34 on the end face surfaces 28, 30 and create an alignment structure for assembly of the two core portions 20. The shape of the elongated projections 38 and the corresponding receiving channels 36 provide a mechanical bond similar to a press fit relationship. The wide male head portion of the elongated projections 38 force the separation and elastic deformation of the end portions the elongated channels 36. In addition, the relief openings 48 at the ends of the elongated channels 36 allow for the adjacent walls of the channel 36 to flex and separate so that the elongated projections may be removed from the channels during disassembly of the two core halves. The shape of the projections and channels is contemplated to be readily moldable without the need for side action or movement within the mold parts prior to separation of the mold along the line of draw.

The internal web members or ribs 26 are provided for strengthening the core halves and the side walls 22, while in effect reducing the overall weight of the core by minimizing the thickness of the sidewall. The external ribs 42 also allow for a more consistent thickness of the sidewall of the core in the area of the end face surfaces. This consistency in wall thickness assists in avoiding cooling anomalies and creates a uniformity in the molded part. The ribs 42 further strengthen the end face surfaces and the mechanical bond of the attachment means formed thereon. The outer edges 46 of the ribs 42 preferably conforms to the contours of the outer sidewall 22 of the core portion 20 and assists in defining a substantially uniform surface for the winding of elongate material on the outer surface of the assembled core 10.

The present disclosure makes reference various exemplary embodiments. It should be understood by those skilled in the art from the foregoing that various other changes, omissions and additions may be made therein, without departing from the spirit and scope of the invention, with the scope of the invention being described by the foregoing claims.

What is claimed is:

1. A two piece core assembly comprising:

a first core portion and a second core portion, the first and second core portions having the same construction and positionable to combine together to form a completed cylindrical and hollow core assembly;

the first and second core portions each comprising a series of projecting pins and a corresponding series of receiving openings, the pins formed on opposing end face surfaces on the core portions from the receiving openings, a series of axially elongated projections and a corresponding series of axially elongated channels, the projections formed on the opposing end face surfaces of the core portions from the channels, and a plurality of raised web members formed on an inside surface of the core portion in a structural crossing pattern, a first portion of the plurality of web members intersecting one another at a midpoint of the inside surface of the core portion, the intersecting web members positioned at an acute angle with respect to a longitudinal axis of the core portion, and a second portion of the plurality of web members positioned perpendicular to the direction of the longitudinal axis, wherein the plurality of web members combining to provide structural rigidity to the core portion.

2. A two piece core assembly as in claim 1 further comprising a plurality of support ribs positioned perpendicular to the end face surfaces.

3. A two piece core assembly as in claim 1 wherein the structural crossing pattern of the plurality of web members further comprises a second plurality of web member intersections formed on opposite side edges of the inside surface adjacent the opposing end face surfaces.

4. A two piece core assembly as in claim 1 wherein projecting pins have a frusto-conical form.

5. A two piece core assembly as in claim 1 wherein the elongated projections comprise a narrow base portion and a bulbous head portion.

6. A two piece core assembly comprising:

a first core portion and a second core portion, the first and second core portions having the same construction and positionable to combine together to form a completed cylindrical and hollow core assembly;

the first and second core portions each comprising a series of projecting pins and a corresponding series of receiving openings, the pins formed on opposing end face surfaces on the core portions from the receiving openings, a series of axially elongated projections and a corresponding series of axially elongated channels, the projections formed on the opposing end face surfaces of the core portion from the channels, and relief openings provided at the ends of the elongated channels, an internal plurality of web members formed in a structural crossing pattern, the web members providing structural rigidity to the core portions, and a plurality of support ribs recessed in an outside wall of the core portions, the support ribs positioned transverse to the opposing end face surfaces.

7. A two piece core assembly as in claim 6 wherein the relief openings assist in the insertion and removal of a bulbous head portion formed on the elongated projections.

8. A two piece core assembly as in claim 7 wherein the elongated projections further comprise a narrow base portion.

9. A two piece core assembly comprising:

a first core portion and a second core portion, the first and second core portions having the same construction and positionable to combine together to form a completed cylindrical and hollow core assembly, the first and second core portions each having a longitudinal axis;

the first and second core portions each comprising a series of projecting pins and a corresponding series of receiving openings formed on opposing end faces on the core portions, a series of axially elongated projections and a corresponding series of axially elongated channels formed on the opposing end faces of the core portions, and an internal plurality of web members formed in a structural crossing pattern on an internal surface of the core portion, the crossing pattern having a plurality of web member intersections formed on both sides of the inside surface adjacent the opposing end faces, and a portion of the web members intersecting one another at a midpoint thereof and the intersections forming an acute angle in the direction facing the end faces, the intersecting web members each forming an acute angle with respect to the longitudinal axis in an axial direction of the core portion, wherein the web members provide structural rigidity to the core portions.

10. A two piece core assembly as in claim 9 wherein a further plurality of web members formed on the internal surface of the core portion and forming the web member intersections, the further plurality of web members positioned perpendicular to the direction of the longitudinal axis of the core portion.

11. A two piece core assembly as in claim 9 further comprising a plurality of support ribs positioned perpendicular to at least one of the end face.

12. A two piece core assembly as in claim 9 wherein projecting pins have a frusto-conical form.

13. A two piece core assembly as in claim 9 wherein the elongated projections comprise a narrow base portion and a bulbous head portion.

14. A two piece core assembly comprising:

a first core portion and a second core portion, the first and second core portions having the same construction and positionable to combine together to form a completed cylindrical and hollow core assembly, the first and second core portions each having a longitudinal axis;

the first and second core portions each comprising a series of projecting pins and a corresponding series of receiving openings formed on opposing end faces on the core portions, a series of axially elongated projections and a corresponding series of axially elongated channels formed on the opposing end faces of the core portions, an internal plurality of web members formed in a structural crossing pattern on an internal surface of the core portion, the crossing pattern having a plurality of web member intersections, and a portion of the web members positioned at an acute angle with respect to the direction of longitudinal axis of the core portion, wherein the web members provide structural rigidity to the core portions, and a plurality of support ribs positioned perpendicular to at least one of the end faces, wherein the plurality of support ribs are formed within an external surface of the core portion.

15. A two piece core portion assembly as in claim 14 wherein the plurality of support ribs are juxtaposed to at least one of the end face.

16. A two piece core assembly comprising a first core portion and a second core portion, the first and second core portions having the same construction and positionable to combine together to form a completed cylindrical and hollow core assembly, the first and second core portions each having a longitudinal axis;

the first and second core portions each comprising a series of projecting pins and a corresponding series of receiving openings formed on opposing end faces on the core portions, a series of axially elongated projections and a corresponding series of axially elongated channels formed on the opposing end faces of the core portions, wherein the elongated projections comprise a narrow base portion and a bulbous head portion, and relief openings provided at the ends of the elongated channels, and an internal plurality of web members formed in a structural crossing pattern on an internal surface of the core portion, the crossing pattern having a plurality of web member intersections, and a portion of the web members positioned at an acute angle with respect to the direction of longitudinal axis of the core portion, wherein the web members provide structural rigidity to the core portions.

17. A two piece core assembly as in claim 16 wherein the relief openings assist in the insertion and removal of a bulbous head portion formed on the elongated projections.

18. A two piece core assembly comprising:

a first core portion and a second core portion, the first and second core portions having the same construction and positionable to combine together to form a completed cylindrical and hollow core assembly, the first and second core portions each having a longitudinal axis;

the first and second core portions each comprising a series of projecting pins and a corresponding series of receiving openings formed on opposing end faces on the core portions, a series of axially elongated projections and a corresponding series of axially elongated channels formed on the opposing end faces of the core portions, and a plurality of web members formed in a structural crossing pattern on an internal surface of the core portion, the crossing pattern having a plurality of endpoint intersections formed on both sides of the inside surface adjacent the opposing end faces, and a portion of the web members forming central intersections at a midpoint between endpoint intersections, and the portion of web members positioned at an acute angle with respect to the longitudinal axis in an axial direction of the core portion, wherein the web members provide structural rigidity to the core portions.

* * * * *